US008733602B1

(12) United States Patent
Bostic

(10) Patent No.: US 8,733,602 B1
(45) Date of Patent: May 27, 2014

(54) CHILD CARRIER

(76) Inventor: Brooke Bostic, Charlottesville, VA (US)

( * ) Notice: Subject to any disclaimer, the term of this patent is extended or adjusted under 35 U.S.C. 154(b) by 789 days.

(21) Appl. No.: 11/888,254

(22) Filed: Jul. 31, 2007

Related U.S. Application Data

(60) Provisional application No. 60/834,531, filed on Jul. 31, 2006.

(51) Int. Cl.
*A61G 1/00* (2006.01)

(52) U.S. Cl.
USPC ..... 224/160; 224/159

(58) Field of Classification Search
USPC ..... 224/158–161, 637–641; 119/770
See application file for complete search history.

(56) References Cited

U.S. PATENT DOCUMENTS 652,352 A * 6/1900 Doell ..... 224/160
1,723,147 A * 8/1929 Baptiste ..... 224/197
4,057,757 A * 11/1977 Darden, Jr. ..... 455/90.3
4,320,863 A * 3/1982 Lyer et al. ..... 224/259
4,560,097 A * 12/1985 Reynolds et al. ..... 224/160
4,993,612 A * 2/1991 Quimby et al. ..... 224/160
5,692,456 A * 12/1997 Louks-Phillips ..... 119/770
5,984,886 A * 11/1999 Miller ..... 602/19
6,098,856 A * 8/2000 Reilly ..... 224/160
6,345,745 B1 * 2/2002 Harriss ..... 224/158
6,651,594 B1 * 11/2003 Bagwell ..... 119/770
7,017,525 B2 * 3/2006 Leach ..... 119/770
7,353,779 B2 * 4/2008 Altieri ..... 119/770
2003/0234267 A1 * 12/2003 Spears ..... 224/159
2006/0254533 A1 * 11/2006 Fuller et al. ..... 119/770

* cited by examiner

*Primary Examiner* — Nathan Newhouse
*Assistant Examiner* — Corey Skurdal
(74) *Attorney, Agent, or Firm* — Sheldon H. Parker, Esq.

(57) ABSTRACT

A child carrier consisting of an adult harness and child harness. The adult harness has an adjustable adult belt with cooperating interlocking closure members to secure the belt around the waist of an adult and adjustable shoulder straps secured to the belt. In some embodiments one end of the shoulder strap is secured to the adult belt by a center strap, secured at approximately the center of the back of the belt, by an adjustable connector. The other end of the shoulder straps can be adjustably affixed to a connector strap that is affixed to said adult belt adjacent to said child foot support member. A child foot support member has a center brace and footrests, preferably hingably attached to either side of the center brace which is secured to the adult belt. The child harness consists of an adjustable child belt dimensioned to fit around the body of the child with releasable securing members at each end. Child shoulder straps have a first end affixed to the child belt and a second end that interlocks with receiving members on the adult belt.

18 Claims, 11 Drawing Sheets

CHILD CARRIER

CROSS-REFERENCE TO RELATED APPLICATIONS

This application is a conversion of provisional application Ser. No. 60/834,531 filed on Jul. 31, 2006 from which it claims priority.

GOVERNMENT INTEREST STATEMENT

NONE

BACKGROUND

1. Field of the Invention

The present invention relates generally to a back carrier for a larger child.

2. Background of the Invention

Many back and front carriers are available for young children and infants. These carriers are generally similar to topless backpacks that provide leg holes for the child's legs with, or without, frames. However, the prior art has not addressed the older child who is still light enough to be carried on the back of a person yet can support themselves in a standing position.

The disclosed child carrier enables an older child to be comfortably carried on the back of an adult in a convenient and safe manner.

SUMMARY OF THE INVENTION

The disclosed child carrier consists of an adult harness and child harness. The adult harness has an adjustable adult belt with cooperating interlocking closure members at each of its open ends to secure the belt around the waist of an adult and at least one at least one shoulder strap with each end of each strap secured to the belt. In some embodiments one end of the shoulder strap is secured to the adult belt by a center strap, secured at approximately the center of the back of the belt, by an adjustable connector. The other end of the shoulder straps can be adjustably affixed to a connector strap that is affixed to said adult belt adjacent to said child foot support member.

A child foot support member is secured to the adult belt. The child foot support member has a center brace and footrests, preferably hingably attached to either side of the center brace. The footrests can also have a non-skid material cover. In some embodiments side rails can be affixed to the footrests to maintain a child's foot in position.

In some embodiments a carrying bag can be attached to the child foot support and/or pockets added to the back of the adult belt or child belt.

The adult harness further comprises a second part of a locking member to receive a locking member on the child shoulder strap.

The child harness consists of an adjustable child belt dimensioned to fit around the body of the child with releasable securing members at each end. Child shoulder straps have a first end affixed to the child belt and a second end with a first part of a locking member that interacts with the second part of the locking member on the adult harness.

BRIEF DESCRIPTION OF THE DRAWINGS

The preferred embodiments of the present invention are shown by a way of example, and not limitation, in the accompanying figures, in which.

DETAILED DESCRIPTION OF THE INVENTION

While the present invention may be embodied in many different forms, a number of illustrative embodiments are described herein with the understanding that the present disclosure is to be considered as providing examples of the principles of the invention and that such examples are not intended to limit the invention to preferred embodiments described herein and/or illustrated herein.

It is advantageous to define several terms before describing the invention. It should be appreciated that the following definitions are used throughout this application.

DEFINITIONS

Where the definition of terms departs from the commonly used meaning of the term, applicant intends to utilize the definitions provided below, unless specifically indicated.

For the purposes herein the term "child carrier" shall refer to any device that enables a child to be more easily carried by an adult or larger child, without using the person's hands.

For the purposes herein the term "securing mechanism" shall refer to any device for attaching one item to another item. This can include, but is not limited to, snaps, screws, rivets, snap clips, stitching, adhesives, buckles, or snap locks.

For purposes herein the term "adjustment mechanism" shall refer to any type of mechanism that enables the length adjustment of an object, such as a belt, strap, tie, or harness. An adjustment mechanism can also include a rigid, telescoping mechanism.

For the purposes herein the term "closing mechanism" refers to any mechanism that securely and releasably maintains to objects together such as a snap lock, belt buckle, hook and loop, knot, or clip.

For the purposes herein the term "hinging" refers to any mechanism that provides flexible support in a first plane while being substantial rigid in a second plane 90 degrees to the first plane.

Figure 1:
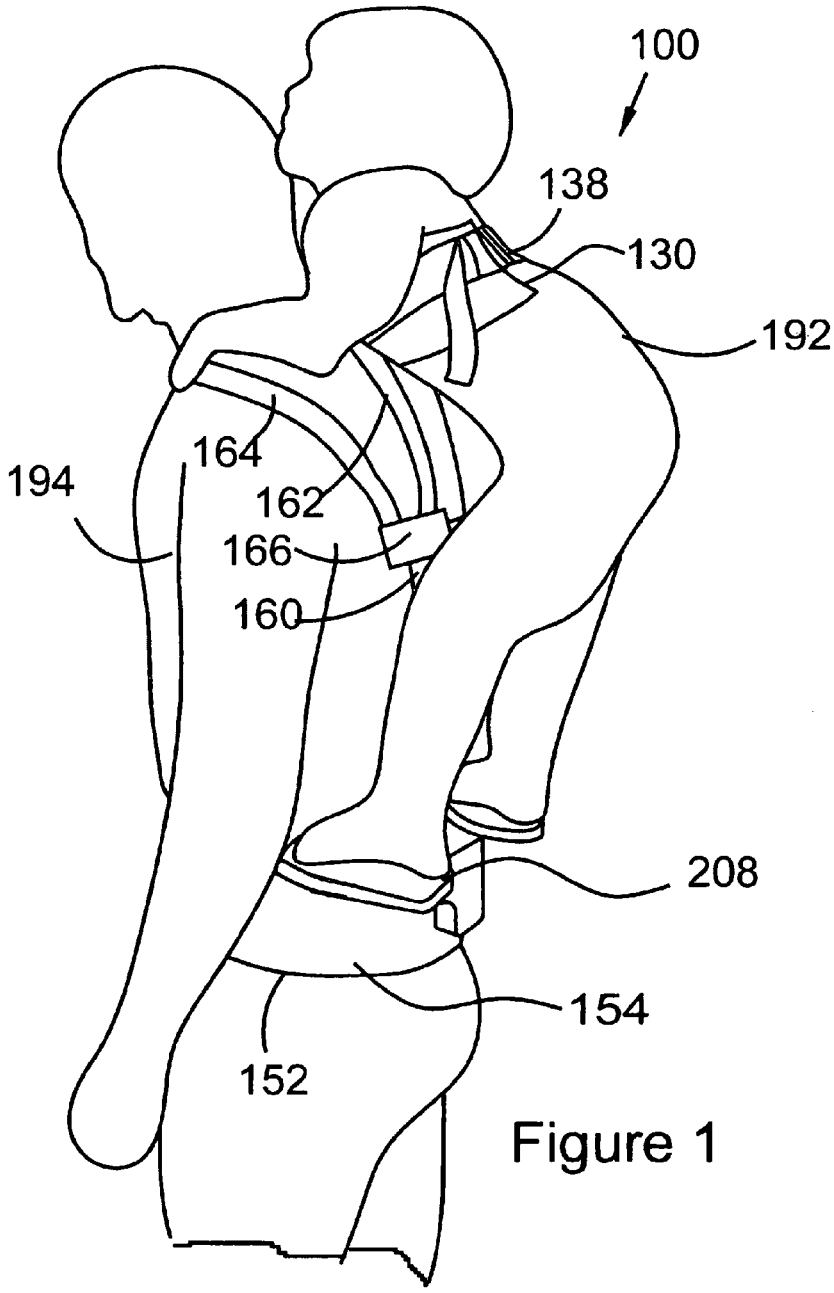
FIG. 1 is a side view of an adult carrying a child using the back carrier in accordance with one of the embodiments of the current invention.

FIG. 1 illustrates the carrier 100 on an adult 194 with a child 192 in the child harness 130 of the carrier 100. The child harness 130 in this embodiment consists of a padded upper body support 138 that is placed around the chest, just under the arms, of the child 192. The child harness 130 is secured to the adult harness 150 through the use of front support straps (not shown).

The adult harness 150 has a waist support 152 that is placed around the waist of the adult 194. Shoulder straps are used to provide additional support and to prevent the waist support 152 from angling away from the back of the adult 194. In this embodiment the center strap 160 extends from approximately the center of the waist support 178 and is then connected to a first shoulder strap 164 and a second shoulder strap 162 which then extend over the shoulders of the adult 194. Both the first shoulder strap 164 and second shoulder strap 162 should be padded for comfort. In the illustrated embodiment the first shoulder strap 164 and second shoulder strap 162 are connected in the front to first connector strap 164*a* and second connector strap 162*a*. The connector straps 164*a* and 162*a* can be unpadded and narrower than the shoulder straps 164 and 162. It is at this junction that additional length adjustment members can be provided. The connector straps 164*a* and 162*a* are connected to the padded belt 154 on each side proximate the footrests 204. This bears weight in conjunction with hip belt itself not in region of hips. Alternatively the padded shoulder straps could extend around the to back, eliminating the connector straps 164*a* and 162*a*. In this embodiment the distance between the first shoulder strap 164 and the second strap 162 is adjustable at connector 166. The adjustment however can be at any convenient location based upon the members used for adjustment.

In this figure the child 192 is standing on the footrests 158, thereby placing the weight of the child 192 at the waist support 152 worn by the adult 194.

Figure 2:
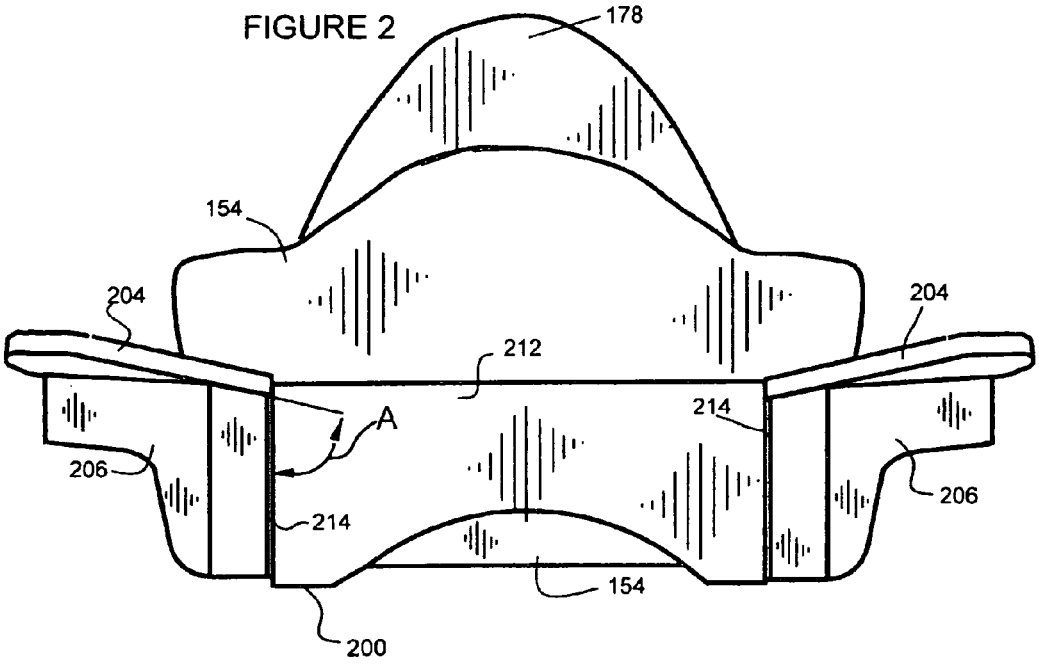
FIG. 2 is a back view of the carrying belt in accordance with one embodiment of the current invention.
Figure 3:
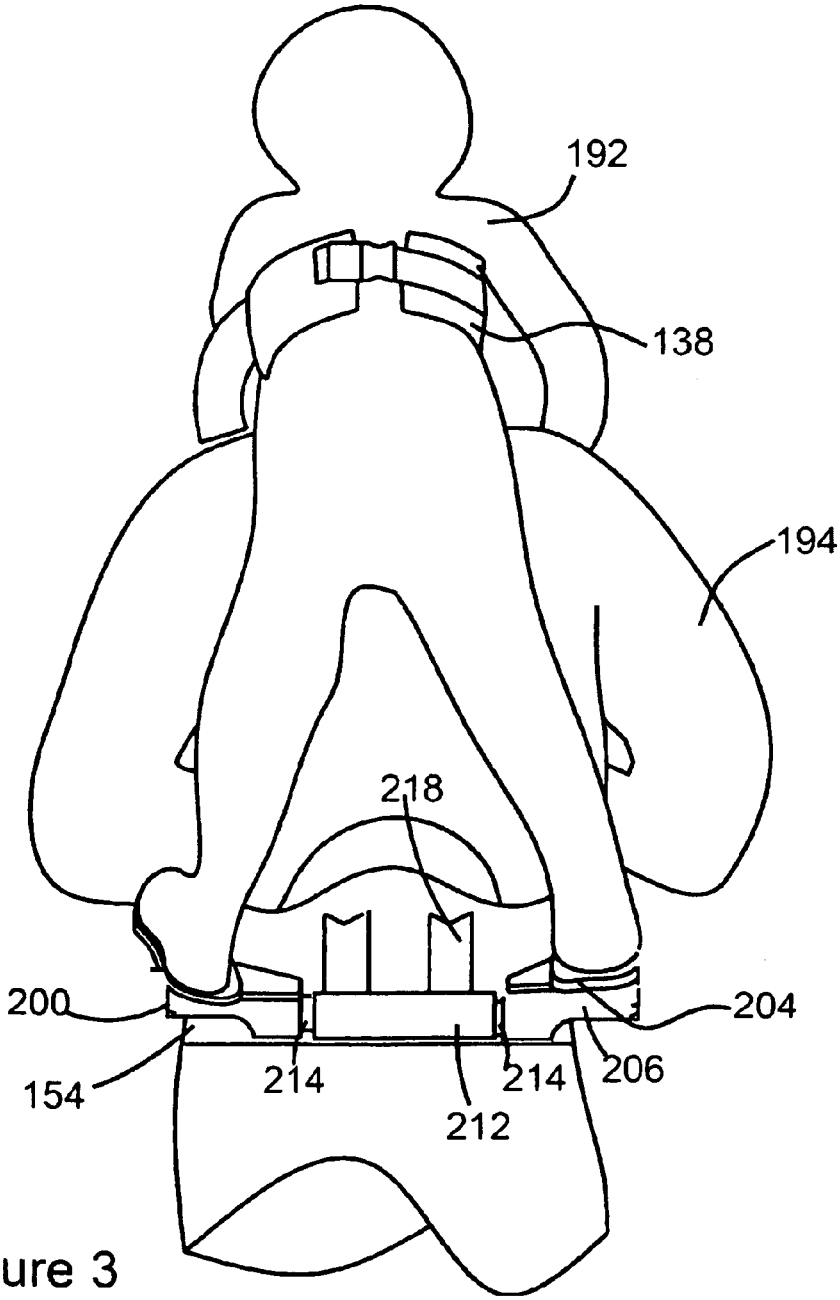
FIG. 3 is a back view of a child standing while in the child carrier in accordance with one of the embodiments of the current invention.
Figure 6:
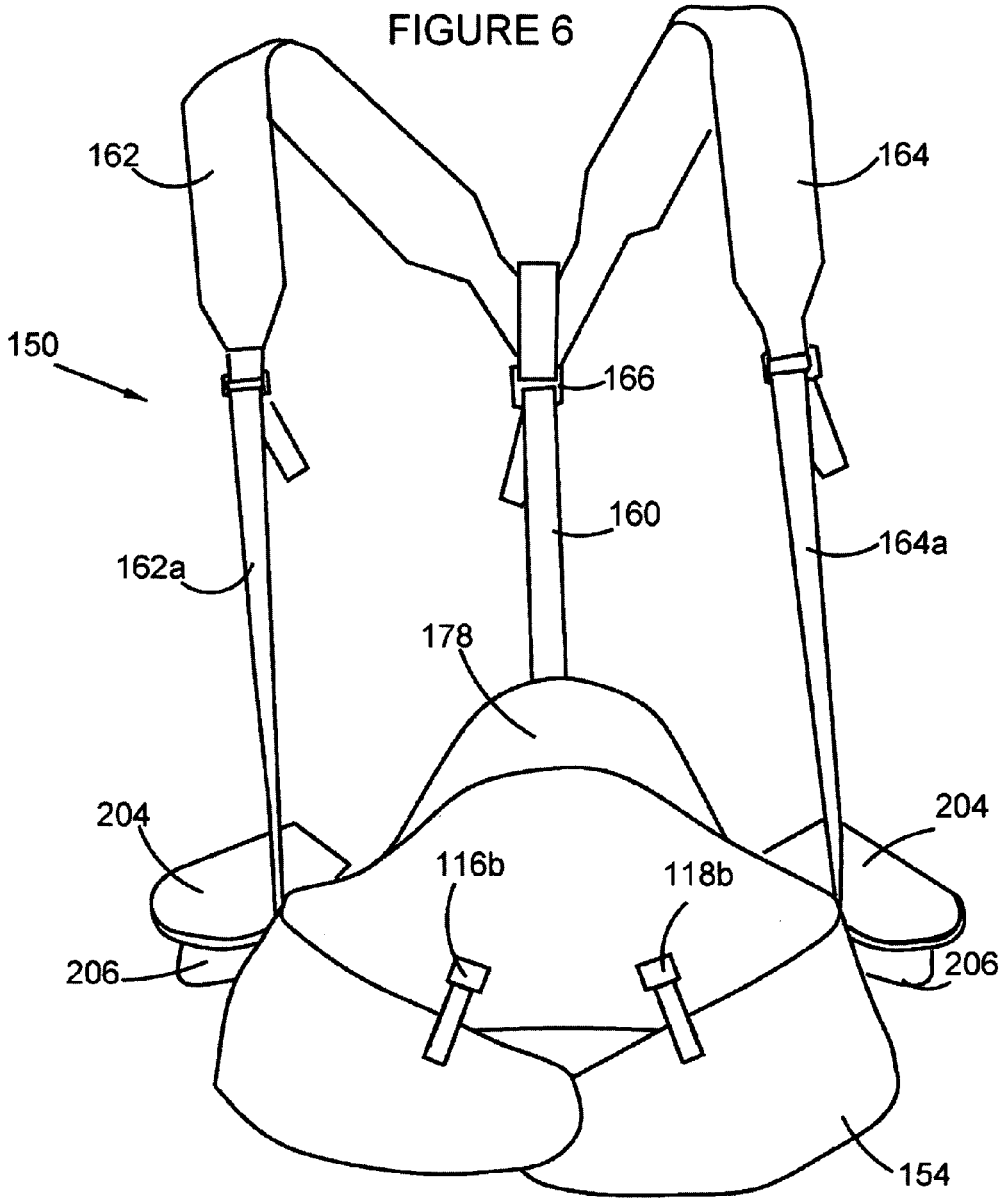
FIG. 6 is a front plan view of the adult harness in accordance with one of the embodiments of the current invention.
Figure 7:
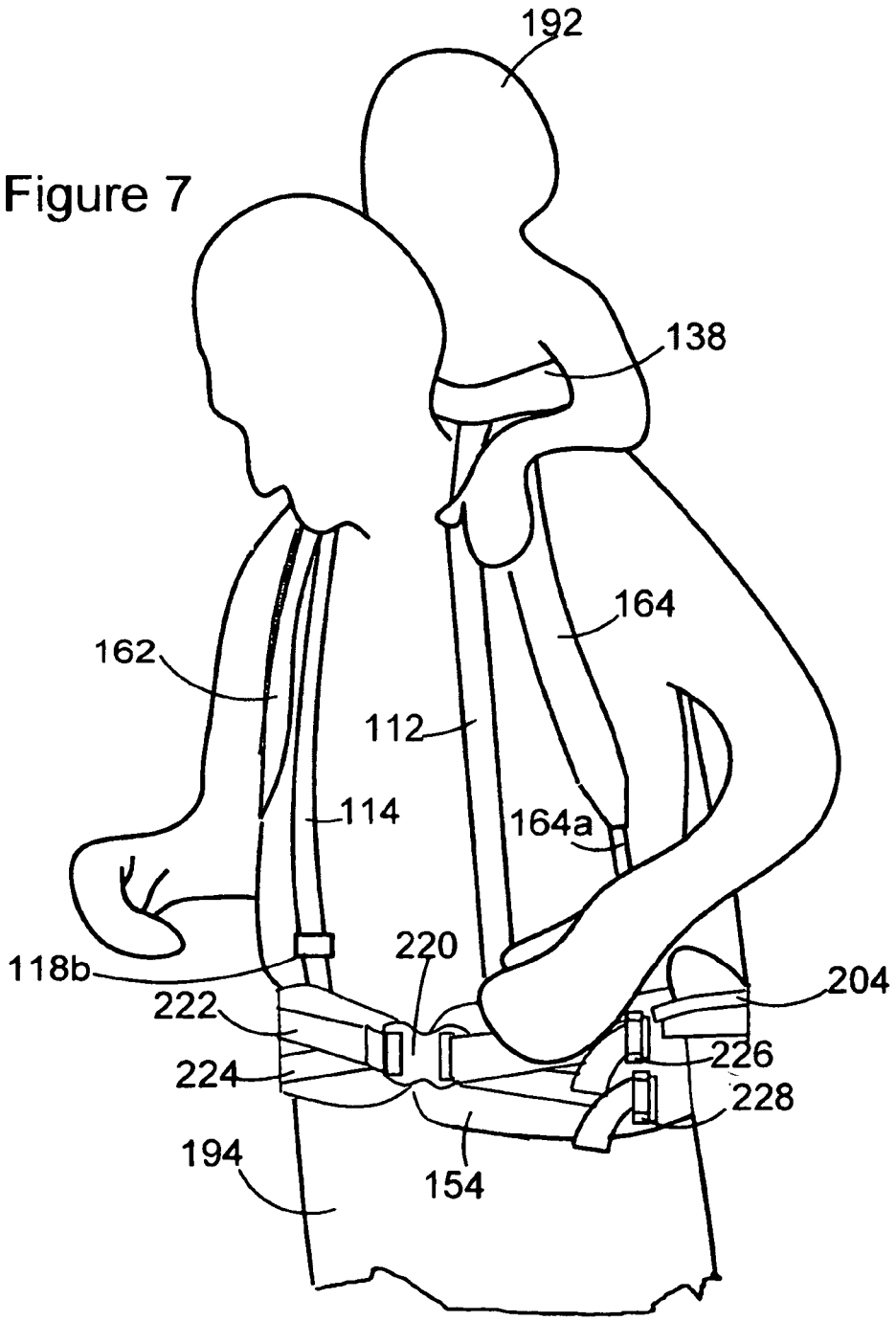
FIG. 7 is a front view of the child be carried in the carrier in accordance with one of the embodiments of the current invention.

The back of the adult belt 154 and support brace 200 are more clearly shown in the back view of FIGS. 2 and 3. In order to provide comfort to the adult 194, the belt 154 should be heavily padded. The belt 154 is preferably open at the front with an easy to release closing mechanism 160 as illustrated in FIGS. 6 and 7. It should be noted that the belt 154 can be anyone of the many commercially available belts that are used, as for example, with backpacks. The belt 154 can also have a back support 178 to provide extra comfort and support for the adult 194. In this embodiment the back support 178 is curved, those will know however any design, height or thickness can be incorporated and appropriate dimensioning and design in proportion to the belt 154 will be know to those skilled in the art.

Figure 9:
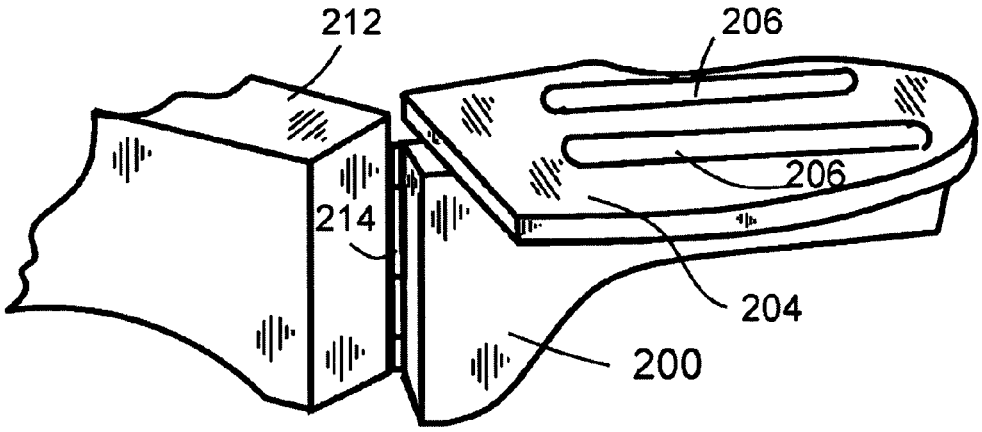
FIG. 9 is a perspective view of the footrest and central support in accordance with one of the embodiments of the current invention.

Attached to the belt 154 is the support brace 200 that provides the rigidity required to support the child 192 as well as enable the child 192 to stand securely. The footrests 204 can vary depending upon the size of the child and the waist of the adult 194. The distance between footrests and the angle of the footrests relative to each other can be adjustable through the use of hinges 214, as illustrated in FIG. 9. While it is preferred that the foot rests 204 be angularly adjustable relative to the belt 154, other types of connections can be used. For example, if the footrests and associated components are made from plastic, a "living hinge" can be used. In order to enable the support brace 200 to conform to the waist of the adult 194 and to comfortably distribute the weight of the child 192, the support brace 200 can be hinged in one or more locations at hinge points 208 and 210.

The brace 200 can be manufactured from any lightweight, rigid material, for example, plastic, wood, or the like. The footrests 204, illustrated in more detail in FIG. 9, are either manufactured from a non-skid material or provided with anti-skid strips 206 as illustrated. The footrests 204 are preferably approximately the length of the child's 192 foot to provide the greatest comfort. As there is a size/weight range that is capable of being carried on an adult's 194 back, a single size footrest 204 can be provided based upon an average size within the size/weight range. Alternatively, the footrests 204 can be made removable and/or adjustable, through screws, snap locks or other applicable securing mechanisms, thereby enabling various sizes to be provided. As can be seen from FIG. 3, the brace 200 has a center support 212 to provide stability to prevent forward or backward rotation of the footrests 204, and to provide additional weight distribution for the adult 194. The footrests 204 are attached to foot supports 206 to provide additionally strength and stability. Although the foot supports 206 illustrated are curved, they can be of any configuration convenient for manufacture. Preferably the foot supports 206 are hingedly connected to the center support 212 through use of hinge members 214 to enable the footrests 204 to be angled to a comfortable position for both the adult 194 and child 192. The hinge members 214 can be standard hinges, self-hinges or any other appropriate members that will provide the flexibility, support and sturdiness required. The center support 212 and the foot supports 206 are affixed to the belt 154 through any means appropriate to the material being used that will provide the required stability and adhesion. Additionally, the supports can be provided with a mechanism to prevent outward rotation of the footrests 204. For example, the support 206 can be adjustably fixed to the belt 154 by means of a strap that is connect to the belt 154 and the supports 206.

If so desired, the back of the belt 154 can have various pockets or other add-ons, such as the pencil holders 218 illustrated in FIG. 3. Alternatively pockets can be added to the child's underarm support 138.

Figure 4:
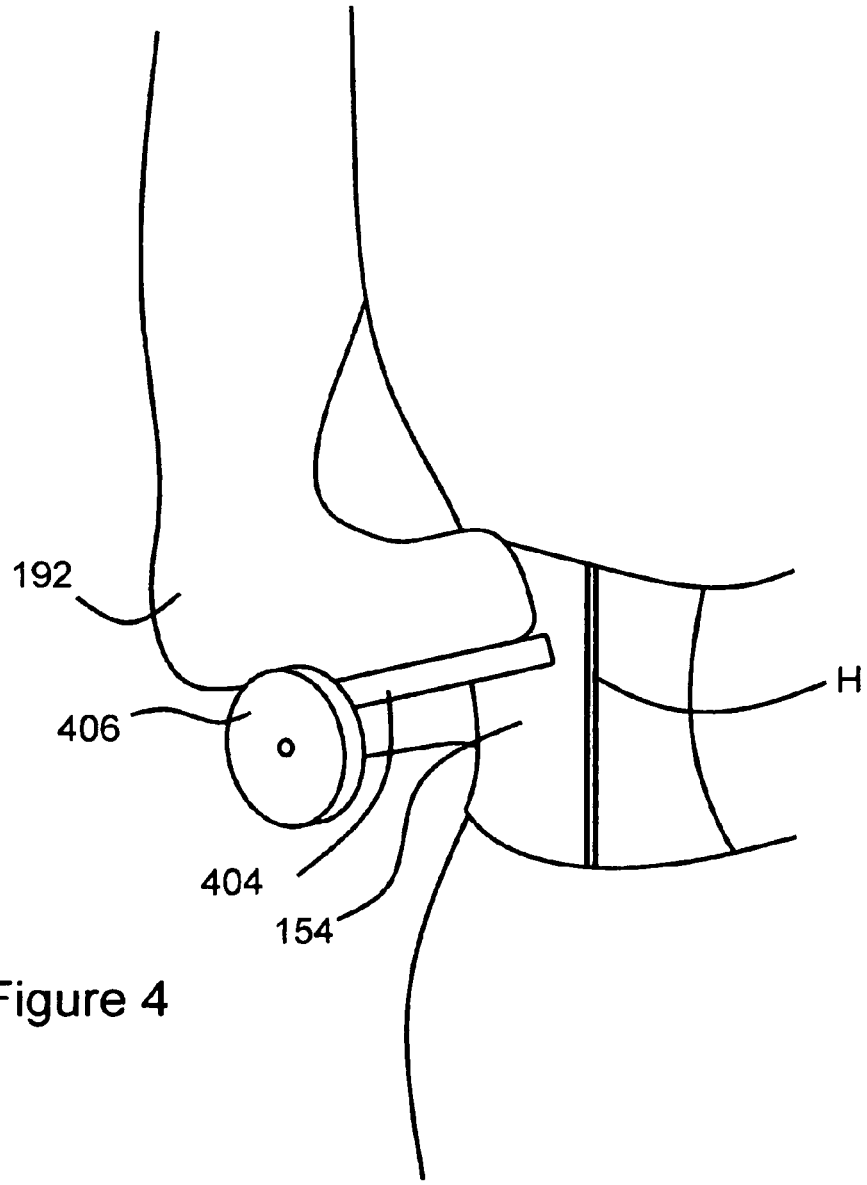
FIG. 4 is side view of the platform showing the footrest and side rail in accordance with one of the embodiments of the current invention.

The placement of the foot of the child 192 on the footrest 404 is illustrated from a side view in FIG. 4. In this FIG. a side rail 406 is shown maintain the foot on the footrest 404. It should be noted that although the side rails 406 are illustrated herein as circles placed near the heel portion of the footrests 404, the side rails 406 can be any configuration, as well as extend the length of one or more sides of the footrests 404. As the footrest 404 is affixed to the belt 154 and proportioned the same as the footrest 204, the positioning of the footrests 404 in relationship to the back of the adult 194 is the same in both embodiments. One example of the height "H" of the belt 154 proximate the footrest 404 is also illustrated in this Figure.

In other embodiments, the foot placement can be shifted forward and the footrests can be offset to such that the plane of the footrest is normal to the line of the child's leg.

Figure 5:
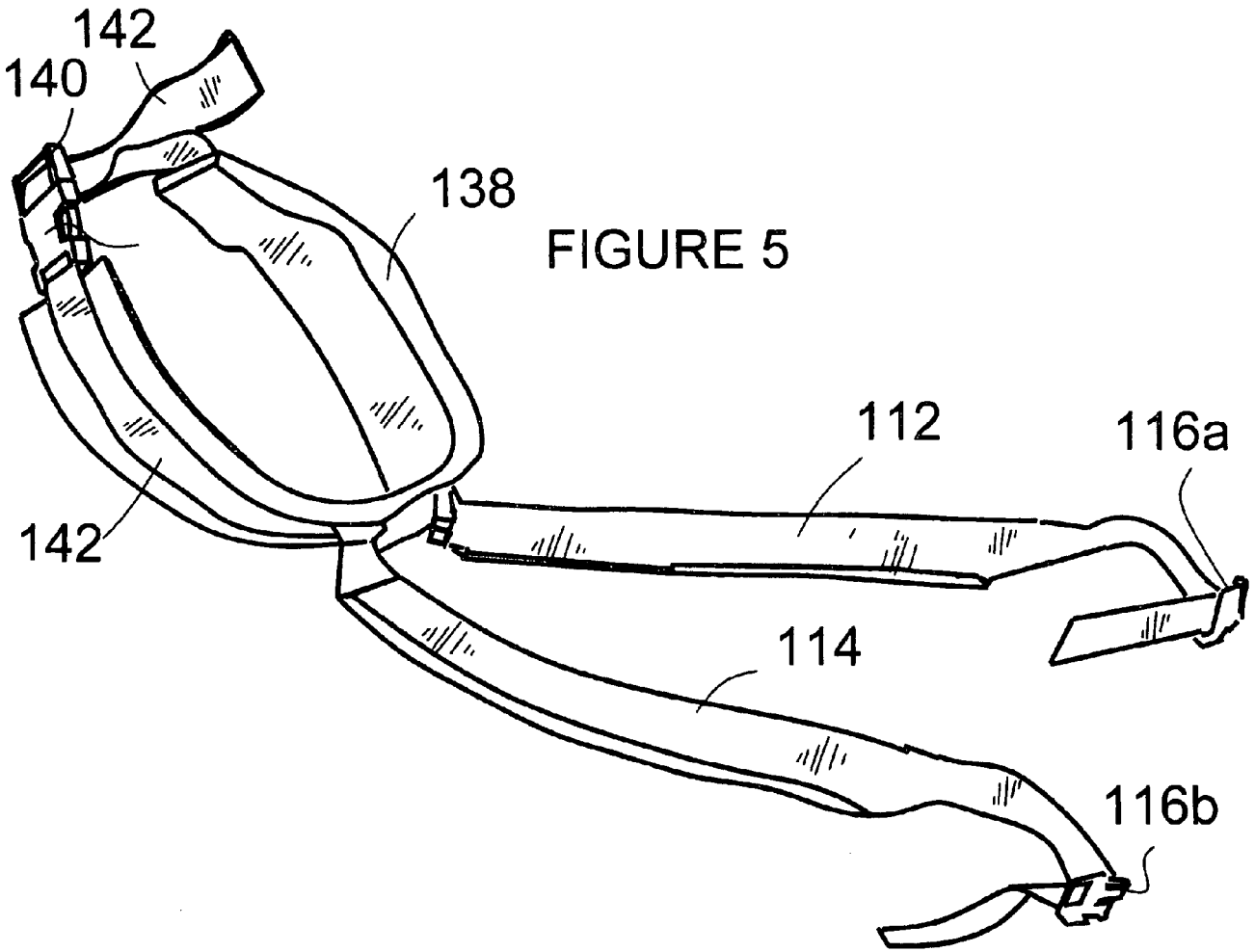
FIG. 5 is a perspective view of the underarm support and shoulder straps for the child harness, in accordance with one of the embodiments of the current invention.

FIG. 5 illustrates the harness indicated generally as 130 for the child 192 of FIG. 1. The underarm support 138, or belt, is secured around the body of the child 192 by closure mechanism 140. In this embodiment, the closure mechanism 140 is a plastic snap lock, adjustable through strap 142 that interacts with the male portion (not shown) of closure mechanism 140. It should be noted that any closure mechanism, as well known in the art, can be used. This enables the underarm support 138 to be adjusted to snuggly, but comfortably, fit the child 192. The shoulder straps 112 and 114 are attached to the underarm support 138 at approximately the center point. In this embodiment the shoulder straps 112 and 114 are a single piece stitched to the underarm support 138. The shoulder straps 112 and 114 can also be connected to the underarm support 138 through various other means, removable and permanent, such as connector loops, snap closures, etc. Additionally, although not necessary, the shoulder straps 112 and 114 can be padded. The shoulder straps 112 and 114 have, at their unattached ends an attachment first portion 116*a* and 118*a* that interact with the attachment second portion 116*b* and 118*b* on the belt 154 to secure the shoulder straps 112 and 114 to the belt 154. The length of the shoulder straps is noted to be adjustable as evident from the adjustable length of strap 112 and 114 that extend from the snap locks, 116*a* and 118*a*. As can be seen in FIG. 6, the shoulder straps 112 and 114, when secured to the belt 154 and to the underarm support 138, prevent the child 192 from falling backward. Although it is illustrated that the underarm support 138, or belt, is placed under the child's arms, in some embodiments the support can be a waist belt. Additionally, a adjustable crotch strap can be added to the child's harness.

FIG. 6 illustrates the adult harness, indicated generally as 150, from the front. In this figure the attachment second portions 116*b* and 118*b* are illustrated extending from the belt 154. Although the footrests 204 and supports 206 extend away from the belt 154 in this Figure, the hinges 214 enable the footrests 204 to be angled closer to the belt 154. As described heretofore the center strap 160 extends from the belt 154 approximate the center of the backrest 178. In this embodiment the center strap 160 is not padded, however a padded strap can be used if so desired. The connector 166 is any type of adjustable connector convenient for manufacture and will be known to those skilled in the art. As described in conjunction with FIG. 1, the shoulder straps 162 and 164 are padded while the connector straps 162*a* and 164*a* can be padded or not, depending upon end use and manufacturing preferences.

Figure 8:
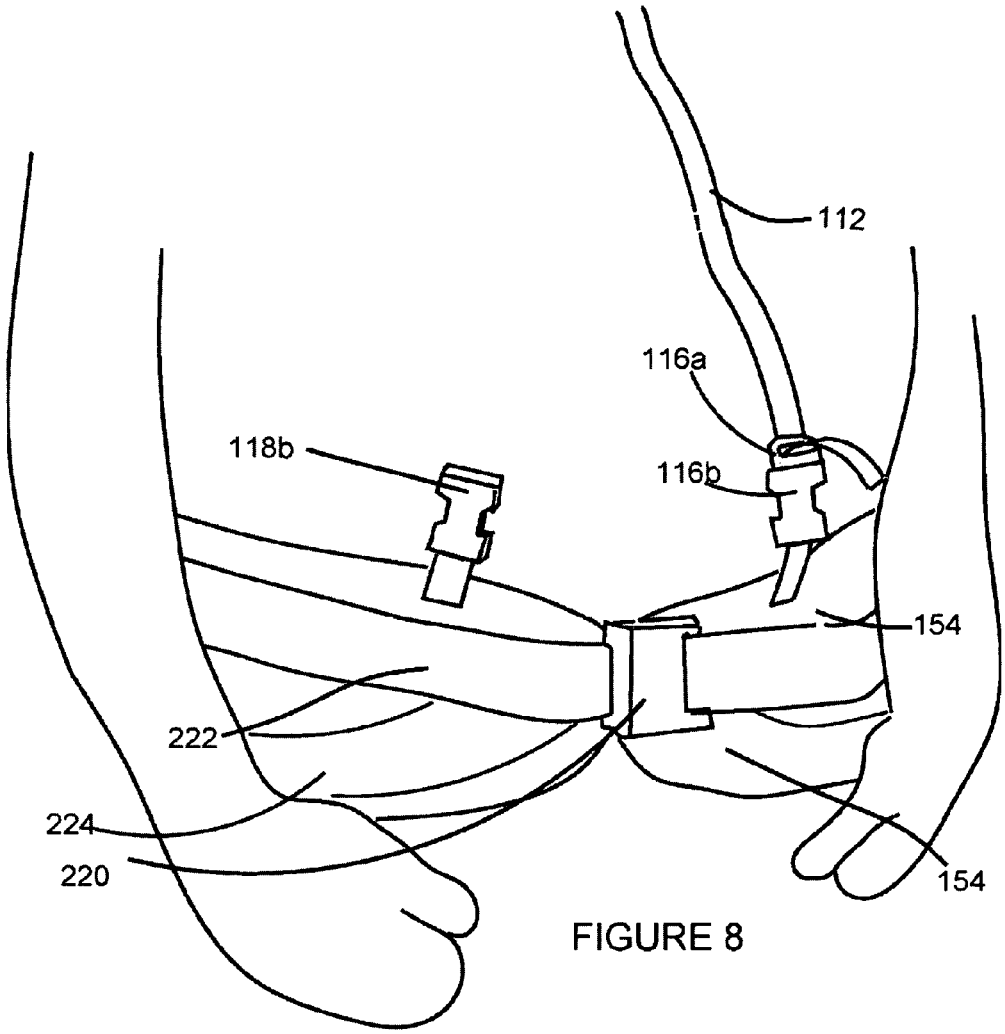
FIG. 8 is front view of the waist support worn by the adult in accordance with one of the embodiments of the current invention.

The closing mechanism illustrated herein is a clip lock, however other mechanisms for securing the waist support 152 around the user's waist can be used, as is also the case for other components that are releasably interconnected. The securing mechanism 220 is secured to one or more belt adjustment straps 222 and 224, illustrated in FIGS. 7 and 8, which permit the length of the belt 154 to be adjusted. The belt adjustment straps 222 and 224 enable the user to size the belt 154, more evenly distribute the pressure over the back of the adult 194 and prevent buckling of the belt 154. Each of the adjustment straps 222 and 224, are secured at one end directly to the belt 154. The adjustment straps 222 and 224 are then looped through the adjustment securing mechanism 226 and 228. The adjustment mechanisms 226 and 228 are secured to the belt 154. Although the adjustment straps illustrated herein are two straps, it should be noted that a single straps can be used on each side and affixed individually to a single securing mechanism.

Figure 10:
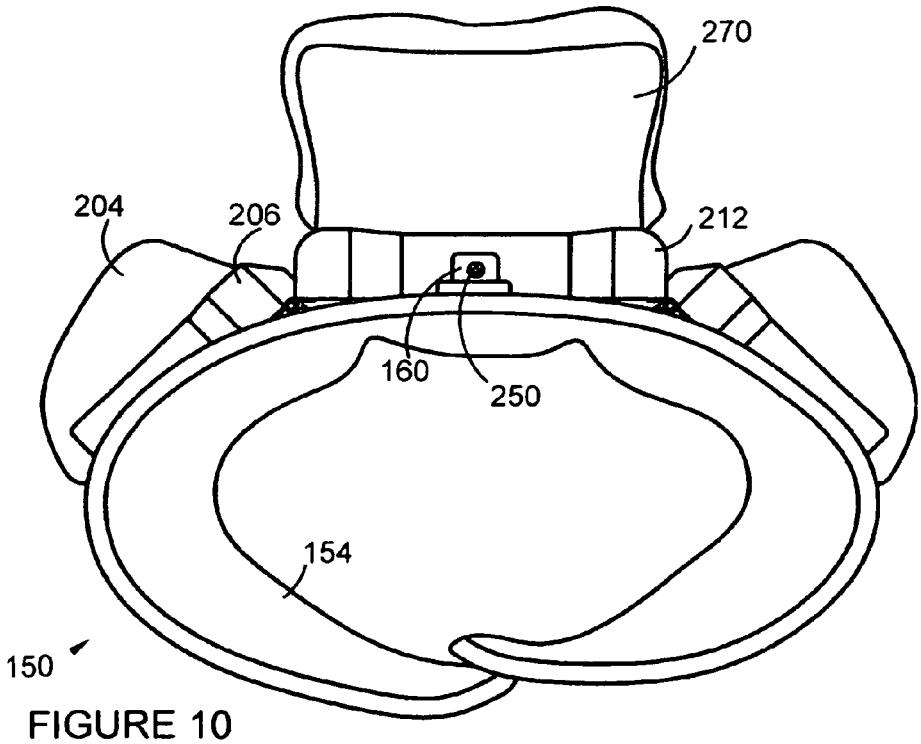
FIG. 10 is a perspective view bottom view of the adult belt with an optional pack attached, in accordance with one of the embodiments of the current invention.
Figure 11:
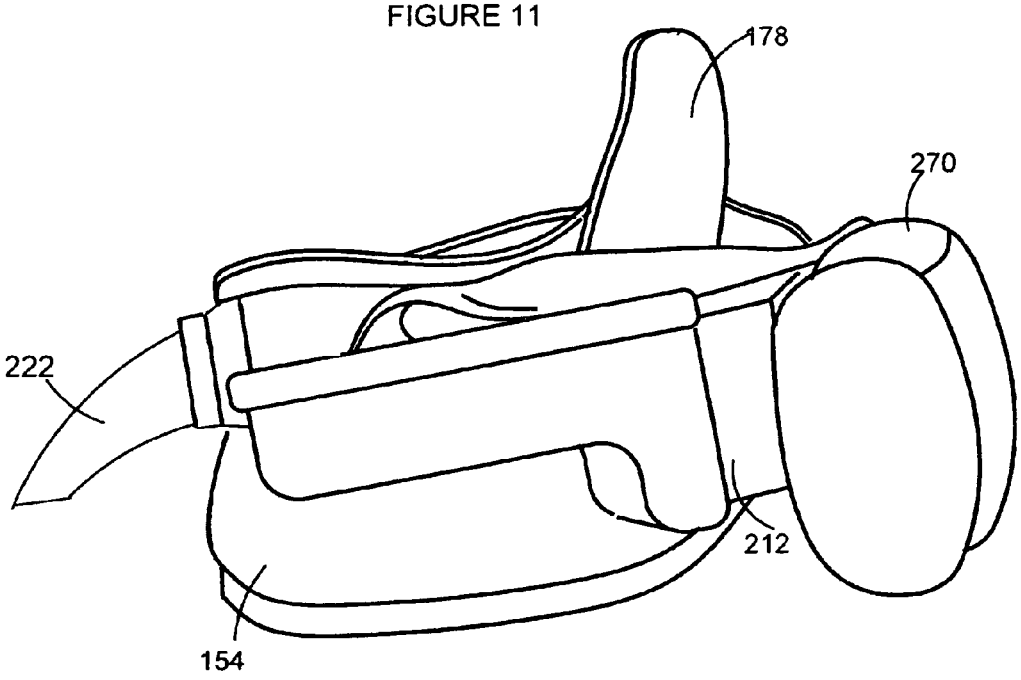
FIG. 11 is a side view of the optional pack of FIG. 10, in accordance with one of the embodiments of the current invention.

FIG. 10 illustrates the belt 154 from the bottom illustrating the footrests 204 extending beyond the footrest support 206. Also shown is the center support strap 160 secured to the center support 212. This embodiment also shows the optional pack 270 that can be affixed, through any appropriate means to the center support 212. The pack 270 is illustrated in FIG. 11 mounted on the center support 212. The belt 154 can be of any design, known in the art, commercially available, or custom designed.

If the child 192 is not standing on the footrest 204 he/she but is hanging, the child is supported under the arms by support 138. In such a case, the weight of the child 192 is borne completely by the straps 112 and 114. As can be noted, the child 192 is substantially lower on the back of the adult 194, held in place by the underarm support 138. This position permits little, freedom of movement since all of the support straps are at maximum extension, as for example, when the child is sleeping. In normal use, when the child 192 is standing on the footrests 204, the vertical pressure on the underarm support 138 is reduced, or eliminated, permitting the child 192 to use the slack in the connection between the underarm support 138 and the shoulder straps 112 and 114.

Aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BROAD SCOPE OF THE INVENTION

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims (e.g., including that to be later added) are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example."

What is claimed is:

1. A child carrier, said child carrier having:

an adult harness, said adult harness having:

an adult belt, said adult belt having two ends, each of said two ends having a cooperating interlocking closure member, said closure member securing said adult belt around the waist of an adult, at least one shoulder strap, each of said at least one shoulder strap having a first end secured to the back of said adult belt and a second end removably secured to a second location on the front of said adult belt, a child foot support member rigidly secured to said adult belt, said child foot support member having a rigid center brace, a first rigid footrest and a second rigid footrest, said first rigid footrest being attached to a first end of said rigid center brace and said rigid second footrest being attached to a second end of said rigid center brace, said first rigid footrest and said second rigid footrest extending from said rigid center brace, a child harness, said child harness having a child belt, said child belt being dimensioned to fit around the body of said child, and having two ends, and cooperating interlocking members on each of said two ends for releasably securing said two ends together.

2. The carrier of claim 1 wherein said child belt further comprises at least one child shoulder strap, a first end of each of said at least one child shoulder strap being affixed to said child belt and a second end of each of said at least one child shoulder strap having a first part of a locking member, and said adult harness further comprises a second part of a locking member to receive said first part of a locking member of said child shoulder strap, said at least one child shoulder strap being positioned, and having a length, to lock said first part of a locking member with said second part of a locking member.

3. The carrier of claim 1, wherein said first rigid footrest and said second rigid footrest are hingably attached to said center brace to enable movement of each of said first rigid footrest and said second rigid footrest on a first plane with respect to said rigid center brace while remaining rigid to said center brace on a second plane.

4. The carrier of claim 1 wherein said first rigid footrest and said second rigid footrest have non-skid material.

5. The carrier of claim 1 wherein each of said first rigid footrest and said second rigid footrest have a side rail to maintain a child's foot on said first rigid footrest and said second rigid footrest.

6. The carrier of claim 1 wherein said first end of each of said at least one shoulder strap said is secured to said adult belt by a center strap having an adjustable connector.

7. The carrier of claim 6 wherein said center strap is secured to said adult belt proximate the center of the back.

8. The carrier of claim 1 wherein each of said second end of said at least one shoulder strap of said adult belt is adjustably affixed to a connector strap attached to said adult belt.

9. The carrier of claim 8 wherein said connector strap is affixed to said adult belt adjacent to said child foot support member.

10. The carrier of claim 1 wherein said adult belt is adjustable.

11. The carrier of claim 1 wherein said child belt is adjustable.

12. The carrier of claim 1 wherein said rigidly secured child foot support further comprises a carrying bag.

13. The carrier of claim 1 wherein said adult belt further comprises pockets.

14. The carrier of claim 1 wherein said first rigid footrest and said second rigid footrest extend from said rigid center brace at about a 90 degree angle.

15. A child carrier, said child carrier having:

an adult harness, said adult harness having:

an adjustable adult belt, said belt having two ends, each of said two ends having a cooperating interlocking closure member, said closure member securing said adult belt around the waist of an adult, at least one shoulder strap, each of said at least one shoulder strap having a first end and a second end, said first end of each of said at least one shoulder strap being secured to approximately the center of the back of said adult belt by a center strap by an adjustable connector and each of said second end of said at least one shoulder strap is adjustably affixed to a connector strap affixed to said adult belt adjacent to a child foot support member, a child foot support member secured to said waist belt, said child foot support member having a center brace and a first footrest and a second footrest, said first footrest being hingably attached to a first end of said center brace and said second footrest being hingably attached to a second end of said center brace, a second part of a locking member to receive a first part of a locking member of a child shoulder strap, a child harness, said child harness having;

an adjustable child belt, said child belt being dimensioned to fit around the body of said child, and having two ends, and cooperating interlocking members on each of said two ends for releasably securing said two ends together, child shoulder straps, a first end of each of said child shoulder strap being affixed to said child belt and a second end of each of said child shoulder strap having a first part of a locking member interacting with said second part of a locking member affixed to said adult belt.

16. The carrier of claim 15 wherein said first footrest and said second footrest have non-skid material.

17. The carrier of claim 15 wherein each of said first footrest and said second footrest have a side rail to maintain a child's foot on said first footrest and said second footrest.

18. The method of carrying a child, comprising the steps of:

a. placing shoulder straps around an adult's shoulders, b. adjusting said shoulder straps to place an adult waist belt at the waist of said adult, c. fastening said adult waist belt around the waist of an adult, d. securing a child belt under the arms of said child, e. placing said child's feet on rigid foot supports mounted to a rigid center support on said waist belt, f. placing at least one support strap secured at one end to said child belt, over a shoulder of said adult, and releasably securing a second end of each of said at least one support strap, to said adult waist band.

* * * * *